US007037140B2

(12) United States Patent
Aekins et al.

(10) Patent No.: US 7,037,140 B2
(45) Date of Patent: May 2, 2006

(54) DUAL REACTANCE LOW NOISE MODULAR CONNECTOR INSERT

(75) Inventors: Robert A. Aekins, Branford, CT (US); George M. Kessler, East Lyme, CT (US); Jay Venditti, East Lyme, CT (US); Joseph E. Dupuis, Ledyard, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 10/998,877

(22) Filed: Nov. 29, 2004

(65) Prior Publication Data

US 2005/0095920 A1 May 5, 2005

Related U.S. Application Data

(62) Division of application No. 09/982,073, filed on Oct. 17, 2001, now Pat. No. 6,896,557.

(60) Provisional application No. 60/282,308, filed on Apr. 5, 2001, provisional application No. 60/279,385, filed on Mar. 28, 2001.

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS

| | | | | |
|---|---|---|---|---|
| 2,714,194 A | | 7/1955 | Beynink | |
| 5,186,647 A | | 2/1993 | Denkmann et al. | |
| 5,269,708 A | * | 12/1993 | DeYoung et al. | 439/676 |
| 5,299,956 A | * | 4/1994 | Brownell et al. | 439/638 |
| 5,310,363 A | | 5/1994 | Brownell et al. | |
| 5,326,284 A | | 7/1994 | Bohbot et al. | |
| 5,341,419 A | | 8/1994 | Ferry | |
| 5,350,324 A | | 9/1994 | Guilbert | |
| 5,362,257 A | | 11/1994 | Neal et al. | |
| 5,399,107 A | | 3/1995 | Gentry et al. | |
| 5,414,393 A | | 5/1995 | Rose et al. | |
| 5,432,484 A | | 7/1995 | Klas et al. | |
| 5,513,065 A | | 4/1996 | Caveney et al. | |
| 5,547,405 A | | 8/1996 | Pinney et al. | |
| 5,586,914 A | | 12/1996 | Foster, Jr. et al. | |
| 5,599,209 A | | 2/1997 | Belopolsky | |
| 5,618,185 A | | 4/1997 | Aekins | |
| 5,639,266 A | * | 6/1997 | Patel | 439/676 |
| 5,647,770 A | | 7/1997 | Belopolsky | |
| 5,674,093 A | | 10/1997 | Vaden | |
| 5,687,478 A | | 11/1997 | Belopolsky | |
| 5,697,817 A | | 12/1997 | Bouchan et al. | |
| 5,759,070 A | | 6/1998 | Belopolsky | |
| 5,779,503 A | | 7/1998 | Tremblay et al. | |
| 5,864,089 A | | 1/1999 | Rainal | |
| 5,911,602 A | | 6/1999 | Vaden | |
| 5,913,702 A | | 6/1999 | Garcin | |

(Continued)

FOREIGN PATENT DOCUMENTS

EP 0 674 364 A1 9/1995

(Continued)

*Primary Examiner*—Briggitte R. Hammond
(74) *Attorney, Agent, or Firm*—McCarter & English, LLP

(57) ABSTRACT

The present invention is related to the modular plug housing insert device that makes electrical contact to a telecommunication plug to complete an interface media connection. The positional relationship of the conductors in the modular plug housing insert device are arranged to from capacitance, such that the Near-end Crosstalk (NEXT) and Far End Crosstalk (FEXT) is reduced without compromising impedance.

15 Claims, 8 Drawing Sheets

U.S. PATENT DOCUMENTS

| | | | |
|---|---|---|---|
| 5,931,703 | A | 8/1999 | Aekins |
| 5,938,479 | A | 8/1999 | Paulson et al. |
| 6,023,200 | A | 2/2000 | Rhee |
| 6,086,428 | A | 7/2000 | Pharney et al. |
| 6,089,923 | A | 7/2000 | Phommachanh |
| 6,113,418 | A | 9/2000 | Kjeldahl |
| 6,120,329 | A | 9/2000 | Steinman |
| 6,155,881 | A | 12/2000 | Arnett et al. |
| 6,183,306 | B1 | 2/2001 | Caveney |
| 6,186,834 | B1 | 2/2001 | Arnett et al. |
| 6,231,397 | B1 | 5/2001 | De la Borbolla et al. |
| 6,290,546 | B1 | 9/2001 | Pharney |
| 6,346,010 | B1 | 2/2002 | Emplit |
| 6,361,354 | B1 | 3/2002 | Viklund et al. |
| 6,379,157 | B1 * | 4/2002 | Curry et al. ..... 439/676 |
| 6,443,777 | B1 | 9/2002 | McCurdy et al. |

FOREIGN PATENT DOCUMENTS

| | | | |
|---|---|---|---|
| EP | 0 955 703 | A2 | 11/1999 |
| EP | 0 955 703 | A3 | 11/2001 |

* cited by examiner

DUAL REACTANCE LOW NOISE MODULAR CONNECTOR INSERT

CROSS-REFERENCE TO RELATED APPLICATION(S)

This application is a divisional application of a co-pending entitled "Dual Reactance Low Noise Modular Connector Insert," which was assigned Ser. No. 09/982,073 and which was filed on Oct. 17, 2001 now U.S. Pat. No. 6,896,557. The foregoing non-provisional application claimed the benefit of commonly owned U.S. Provisional Application No. 60/282,308, filed Apr. 5, 2001 and entitled "Modular Jack," and Provisional application Ser. No. 60/279,385, filed Mar. 28, 2001, the disclosure of which is also herein incorporated by reference.

BACKGROUND OF THE DISCLOSURE

1. Technical Field

The present disclosure relates to devices for interfacing with high frequency data transfer media and, more particularly, to modular jack housing inserts, such as those that are used as interface connectors for Unshielded Twisted Pair ("UTP") media, that advantageously compensate for and reduce electrical noise.

2. Background Art

In data transmission, the signal originally transmitted through the data transfer media is not necessarily the signal received. The received signal will consist of the original signal after being modified by various distortions and additional unwanted signals that affect the original signal between transmission and reception. These distortions and unwanted signals are commonly collectively referred to as "electrical noise," or simply "noise." Noise is a primary limiting factor in the performance of a communication system. Many problems may arise from the existence of noise in connection with data transmissions, such as data errors, system malfunctions and/or loss of the intended signals.

The transmission of data, by itself, generally causes unwanted noise. Such internally generated noise arises from electromagnetic energy that is induced by the electrical energy in the individual signal-carrying lines within the data transfer media and/or data transfer connecting devices, such electromagnetic energy radiating onto or toward adjacent lines in the same media or device. This cross coupling of electromagnetic energy (i.e., electromagnetic interference or EMI) from a "source" line to a "victim" line is generally referred to as "crosstalk."

Most data transfer media consist of multiple pairs of lines bundled together. Communication systems typically incorporate many such media and connectors for data transfer. Thus, there inherently exists an opportunity for significant crosstalk interference.

Crosstalk can be categorized in one of two forms. Near end crosstalk, commonly referred to as NEXT, arises from the effects of near field capacitive (electrostatic) and inductive (magnetic) coupling between source and victim electrical transmissions. NEXT increases the additive noise at the receiver and therefore degrades the signal to noise ratio (SNR). NEXT is generally the most significant form of crosstalk because the high-energy signal from an adjacent line can induce relatively significant crosstalk into the primary signal. The other form of crosstalk is far end crosstalk, or FEXT, which arises due to capacitive and inductive coupling between the source and victim electrical devices at the far end (or opposite end) of the transmission path. FEXT is typically less of an issue because the far end interfering signal is attenuated as it traverses the loop.

Characteristics and parameters associated with electromagnetic energy waves can be derived by Maxwell's wave equations. In unbounded free space; a sinusoidal disturbance propagates as a transverse electromagnetic wave. This means that the electric field vectors are perpendicular to the magnetic field vectors lying in a plane perpendicular to the direction of the wave. As a result, crosstalk generally gives rise to a waveform shaped differently than the individual waveform(s) originally transmitted.

Unshielded Twisted Pair cable or UTP is a popular and widely use type of data transfer media. UTP is a very flexible, low cost media, and can be used for either voice or data communications. In fact, UTP is rapidly becoming the defacto standard for Local Area Networks ("LANs") and other in-building voice and data communications applications. In a UTP, a pair of copper wires generally form the twisted pair. For example, a pair of copper wires with diameters of 0.4–0.8 mm may be twisted together and wrapped with a plastic coating to form a UTP. The twisting of the wires increases the noise immunity and reduces the bit error rate (BER) of the data transmission to some degree. Also, using two wires, rather than one, to carry each signal permits differential signaling to be used. Differential signaling is generally more immune to the effects of external electrical noise.

The non-use of cable shielding (e.g., a foil or braided metallic covering) in fabricating UTP generally increases the effects of outside interference, but also results in reduced cost, size, and installation time of the cable and associated connectors. Additionally, non-use of cable shielding in UTP fabrication generally eliminates the possibility of ground loops (i.e., current flowing in the shield because of the ground voltage at each end of the cable not being exactly the same). Ground loops may give rise to a current that induces interference within the cable, interference against which the shield was intended to protect.

The wide acceptance and use of UTP for data and voice transmission is primarily due to the large installed base, low cost and ease of new installation. Another important feature of UTP is that it can be used for varied applications, such as for Ethernet, Token Ring, FDDI, ATM, EIA-232, ISDN, analog telephone (POTS), and other types of communication. This flexibility allows the same type of cable/system components (such as data jacks, plugs, cross-patch panels, and patch cables) to be used for an entire building, unlike shielded twisted pair media ("STP").

At present, UTP is being used for systems having increasingly higher data rates. Since demands on networks using UTP systems (e.g., 100 Mbit/s and 1200 Mbit/s transmission rates) have increased, it has become necessary to develop industry standards for higher system bandwidth performance. Systems and installations that began as simple analog telephone service and low speed network systems have now become high speed data systems. As the speeds have increased, so too has the noise.

The ANSI/TIA/EIA 568A standard defines electrical performance for systems that utilize the 1 to 100 MHz frequency bandwidth range. Exemplary data systems that utilize the 1–100 MHz frequency bandwidth range include IEEE Token Ring, Ethernet10Base-T and 100Base-T. ANSI/TIA/EIA-568 and the subsequent TSB-36 to TSB-40 standards define five categories, as shown in the following Table, for quantifying the quality of the cable (for example, only Categories 3, 4, and 5 are considered "datagrade UTP").

TABLE

| Category | Characteristic specified up to (MHz) | Various Uses |
|---|---|---|
| 1 | None | Alarm systems and other non-critical applications |
| 2 | None | Voice, EIA-232, and other low speed data |
| 3 | 16 | 10BASE-T Ethernet, 4-Mbits/s Token Ring, 100BASE-T4, 100VG-AnyLAN, basic rate ISDN. Generally the minimum standard for new installations. |
| 4 | 20 | 16-Mbits/s Token Ring. Not widely used. |
| 5 | 100 | TP-PMD, SONet, OC-3 (ATM), 100BASE-TX. The most popular for new data installations. |

UTP cable standards are also specified in the EIA/TIA-568 Commercial Building Telecommunications Wiring Standard, including the electrical and physical requirements for UTP, STP, coaxial cables, and optical fiber cables. For UTP, the requirements currently include:

Four individually twisted pairs per cable

Each pair has a characteristic impedance of 100 Ohms +/−15% (when measured at frequencies of 1 to 100 MHz)

24 gauge (0.5106-mm-diameter) or optionally 22 gauge (0.6438 mm diameter) copper conductors are used Additionally, the ANSI/EIA/TIA-568 standard specifies the color coding, cable diameter, and other electrical characteristics, such as the maximum cross-talk (i.e., how much a signal in one pair interferes with the signal in another pair—through capacitive, inductive, and other types of coupling). Since this functional property is measured as how many decibels (dB) quieter the induced signal is than the original interfering signal, larger numbers reflect better performance.

Category 5 cabling systems generally provide adequate NEXT margins to allow for the high NEXT associated with use of present UTP system components. Demands for higher frequencies, more bandwidth and improved systems (e.g., Ethernet 1000Base-T) on UTP cabling, render existing systems and methods unacceptable. The TIA/EIA category 6 draft addendum related to new category 6 cabling standards illustrates heightened performance demands. For frequency bandwidths of 1 to 250 MHz, the draft addendum requires the minimum NEXT values at 100 MHz to be −39.9 dB and −33.1 dB at 250 MHz for a channel link, and −54 dB at 100 MHz and −46 dB at 250 MHz for connecting hardware. Increasing the bandwidth for new category 6 (i.e., from 1 to 100 MHz in category 5 to 1 to 250 MHz in category 6) increases the need to review opportunities for further reducing system noise.

The standard modular jack housing is configured and dimensioned so as to provide maximum compatibility and matability between various manufacturers, e.g., based on the FCC part 68.500 mechanical dimension. Two types of offsets have been produced from the FCC part 68.500 modular jack housing dimensions.

Type one is the standard FCC part 68.500 style for modular jack housing and such standard housing does not add or include any compensation methods to reduce crosstalk noises. The standard modular jack housing utilizes a straightforward design approach and, by alignment of lead frames in a relatively uniform, parallel pattern, high NEXT and FEXT are produced for certain adjacent wire pairs.

This type one or standard FCC part 68.500 style of modular jack housing connector is defined by two lead frame section areas. The first section is the matable area for electrical plug contact and section two is the output area of the modular jack housing. Section one aligns the lead frames in a relatively uniform, parallel pattern from lead frame tip to the bend location that enters section two, thus producing high NEXT and FEXT noises. Section two also aligns the lead frames in a relatively uniform, parallel pattern from lead frame bend location to lead frame output, thus producing and allowing additional high NEXT and FEXT noises.

There have been approaches that are intended to reduce the crosstalk noises associated with these type one or standard modular jack housings. For example, U.S. Pat. No. 5,674,093 to Vaden et al. discloses an electrical connector having an irregular bend in one lead frame of each pair. The irregular bend reduces the parallelism of the lead frames to contribute to reductions in potential coupling effects. Although crosstalk noise may be reduced, forming lead frames as disclosed in the Vaden '093 patent is a complex process and the return loss and differential impedance in the circuit is disadvantageously increased for all four pairs.

The second type of modular jack housing is the standard FCC part 68.500 style for modular jack housings that incorporate compensation methods to reduce crosstalk noises.

For example, U.S. Pat. No. 5,639,266 to Stewart discloses a compensation approach for modular jack housings that involves aligning the lead frames of the opposite pairs in an uniformed parallel pattern to removed crosstalk noises. The Stewart connector is defined by two lead frame section areas, section one being the matable area for electrical plug contact and section two being the output area of the modular jack housing. Stewart's section one aligns two lead frames, namely, positions 3 and 5 out of 8, in an uniformed and reversed signal parallel pattern from lead frame tip to the bend location that enters section two, thus reducing crosstalk noises by signal compensation. Section two also aligns the lead frames in an uniformed parallel pattern from lead frame bend location to lead frame stagger array output, which minimizes NEXT, but due to the imbalances of the center wire pairs 1 and 3, FEXT noises are disadvantageously increased according to the Stewart '266 design.

Another example of crosstalk compensation methodology is disclosed in U.S. Pat. No. 5,647,770 to Berg and U.S. Pat. No. 5,779,503 to Nordx/CDT. These two patents disclose compensation approaches for modular jack housings that involve aligning and re-bending the lead frames of the opposite pairs in an uniformed parallel pattern to contribute to crosstalk noise reduction. The Berg and Nordx/CDT devices utilize defacto standard rear entry pin positions of 0.1 inch separation for all pair arrays after the deformation of the wire pairs. The re-bending of lead frames as disclosed by the Berg '770 and Nordx/CDT '503 patents is an expensive process and the crosstalk reductions addressed by these disclosures occur mainly within the second section of their respective designs. Another method for crosstalk noise reduction and control in connecting hardware is addressed in commonly assigned U.S. Pat. No. 5,618,185 to Aekins, the disclosure of which is hereby incorporated by reference.

In view of the increasing performance demands being placed on UTP systems, e.g., the implementation of category 6 standards, it would be beneficial to provide a device and/or methodology that reduces NEXT and FEXT noises associated with standard FCC part 68.500 modular jack housings in a simple and cost effective manner. These and other objectives are achieved through the advantageous modular jack housings disclosed herein.

SUMMARY OF THE DISCLOSURE

The present disclosure provides a modular plug dielectric insert device for a data/voice communication system modular jack housing that advantageously reduces NEXT and FEXT.

In another aspect of the present disclosure, a modular plug dielectric insert device is disclosed that is particularly adapted for being seated in a data/voice communication system modular jack housing that will reduce signal delay from the plugs input to the IDC terminal outputs to better control NEXT and FEXT of a connecting hardware.

In addition, a modular jack dielectric insert device for data/voice systems is provided that will not deform the wire pairs in a standard EIA T568B style wire configuration and is simple, low cost and easy to implement into a modular housing. Preferred lead frame wires according to the present disclosure are simple in form, but are precisely bent in proper direction(s) to reduce noise and re-balance the signal pairs in a simple and low cost manner, without reducing the impedance characteristics of the wire pairs.

Devices and/or systems according to the present disclosure include an insert in the data signal transmission media plug receiving space of a modular housing. The insert is preferably composed of a dielectric support member having a plurality of pairs of electrically conductive elongated members. Each elongated member generally includes a front end portion which includes a contact portion exposed in the receiving space of the modular housing for making electrical contact with the media plug contacts. The elongated conductive members also have rear end portions that include an electrically conductive connector device for connecting and transmitting a signal to other devices. The use of the terms "front" and "rear" is in no way meant to be limiting. A substantial amount of the electrical noise is removed according to the present disclosure by the positional relationships of the elongated members with respect to each other. Thus, a capacitance is formed by the adjacency and/or degree of separation of the members which advantageously compensates for electrical noise during transmission of a signal.

In one aspect in accordance with the present disclosure, the plurality of pairs of elongated members have substantially multilaterally symmetrical portions and substantially multilaterally asymmetrical portions.

In another aspect in accordance with the present disclosure, the front end portions of the elongated conductive members are substantially multilaterally symmetrical and the rear end portions are substantially multilaterally asymmetrical.

In another aspect in accordance with the present disclosure, the front end portions are substantially parallel.

In another aspect in accordance with the present disclosure, each pair of the plurality of pairs of elongated members includes a ring member and a tip member. The ring and tip members may be separated so that the ring members are on the same plane, that is, in one row, and the tip members are in another row. Preferably, these rows of conductors are spaced apart.

In another aspect in accordance with the present disclosure, the front end portions of the elongated members may be partially or fully made up of arcuate sections that extend the elongated members into the receiving space, and aid with mating forces between the plug and insert, among other things.

Preferably, the disclosed insert is used in a modular jack for receiving and compensating a signal transmitted through the eight leads from a standard RJ45 wire plug. The EIA T568B has eight positions numbered 1–8 which are paired as follows: 1–2 (pair 2), 3–6 (pair 3), 4–5 (pair 1), 7–8 (pair 4). For the EIA T568B or T568A style configurations of category 5 and 6 UTP cabling (and most others), there are also eight positions. Thus, there are eight elongated conductive elements disposed on the dielectric support member. Again, each element has a front portion with a contact portion for establishing electrical contact with one of the eight leads and each rear portion has a connecting device for further transmission of the signal. These conductive elements are advantageously arranged in a positional relationship with respect to each other for forming a capacitance to compensate electrical noise during transmission of the signal. This advantageous positional relationship may involve positioning the front portions of the eight conductive elements in a substantially parallel alignment along a longitudinal axis, and having the rear portions include parallel portions as well as portions transverse to the longitudinal axis.

An arrangement for compensating cross-talk noise in an electrical signal is also disclosed herein, such arrangement including a dielectric modular jack housing having a signal transmission media receiving space for signal transmission media having a plurality of conductive members, such as a UTP cable and plugs. The plurality of pairs of elongated conductors are disposed in the signal transmission media receiving space. Each elongated conductor has a front end portion with a contact area for mating with the signal transmission media and a back end portion that includes a connecting device for connecting with a terminal on a printed circuit board ("PCB"). The PCB may have multiple terminals for connecting with other electrically conductive media, such as a UTP cable. In accordance with the present disclosure, the plurality of pairs of elongated conductors are in a positional relationship with respect to each other to form a capacitance for compensating electrical noise in a signal transmission. The positional relationship may involve the front end portions being substantially parallel with respect to each other along a longitudinal axis and/or the rear end portions being partially parallel and partially transverse with respect to the axis.

The electrical noise may be reduced by the positional relationship which advantageously results in a combination of dual and separate signal feedback reactances. The reactances in the insert device compensate for pair to pair NEXT, FEXT and impedance in a simple and cost effective unit solution.

These and other unique features of the method of the systems, devices and methods of the present disclosure will become more readily apparent from the following description of the drawings taken in conjunction with the detailed description of preferred and exemplary embodiments.

BRIEF DESCRIPTION OF THE DRAWINGS

So that those having ordinary skill in the art to which the subject disclosure appertains will more readily understand how to construct and employ the subject disclosure, reference may be had to the drawings wherein.

Figure 1:
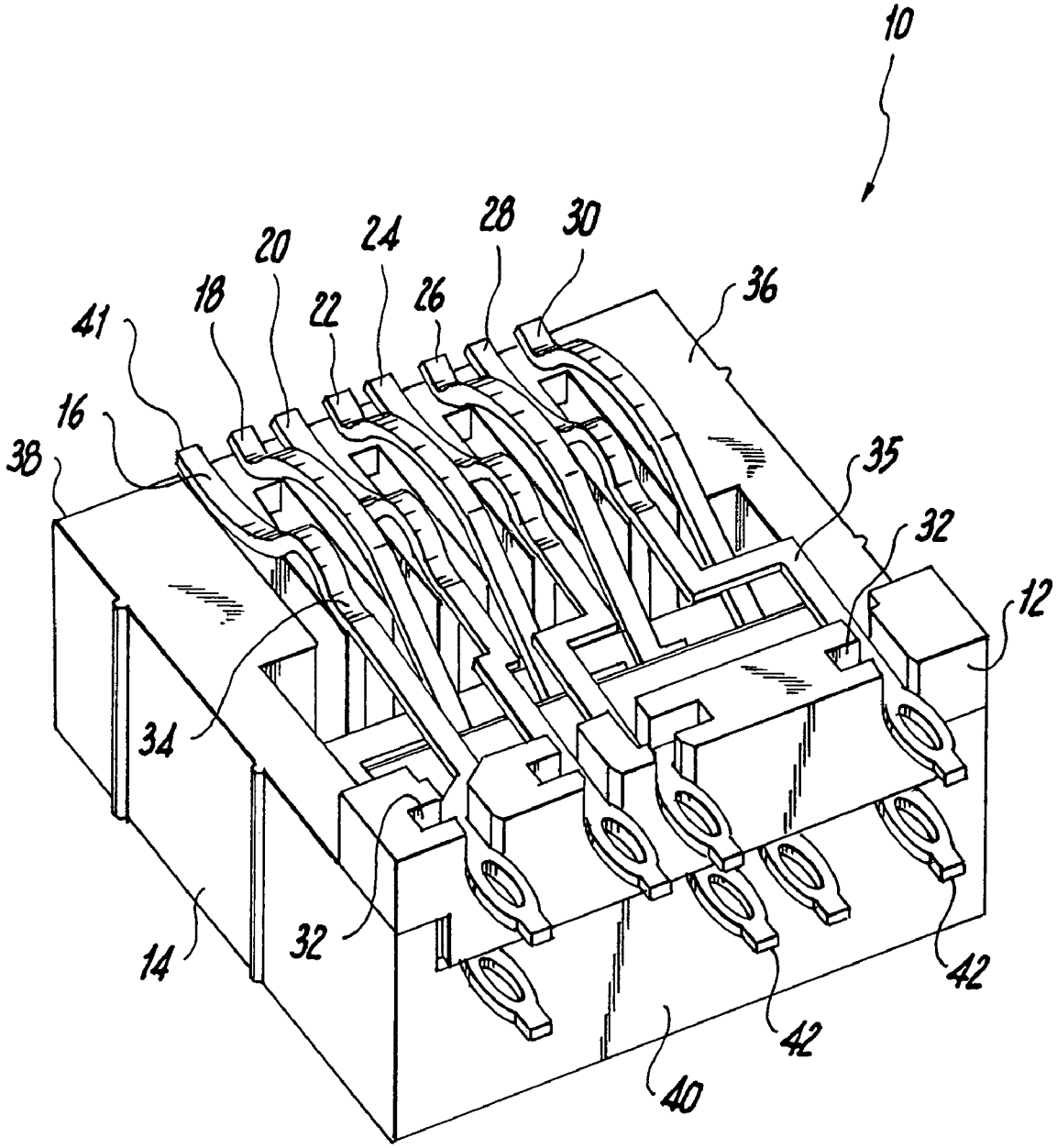
FIG. 1 is a perspective view of an exemplary insert device in accordance with the present disclosure.

These and other features of the method of the subject disclosure will become more readily apparent to those having ordinary skill in the art from the following detailed description of preferred and exemplary embodiments.

DETAILED DESCRIPTION OF PREFERRED EMBODIMENT(S)

Referring now to the drawings, FIGS. 1–12 illustrate an embodiment of a dielectric interface modular insert 10 in accordance with the present disclosure. Insert 10 has an upper portion 12 seated on a lower portion 14, with electrically conductive lead frames 16, 18, 20, 22, 24, 26, 28 and 30 being disposed between. Preferably, upper portion 12 and lower portion 14 are fabricated from a low dielectric material, such as plastic.

Insert 10 contains terminals having 8 lead frames in accordance with most standard wiring formations, such as the T568B and T568A style RJ45 plugs. The TIA/EIA commercial building standards have defined category 5e and 6 electrical performance parameters for higher bandwidth (100 up to 250 MHz) systems. In category 5e and 6, the TIA/EIA RJ45 wiring style is the preferred formation and is generally followed throughout the cabling industry.

Lead frames 16 through 30 are engaged in channel slots 32 with cut outs in upper portion 12 and lower portion 14. The cut outs are provided so as to permit contact portions 34 on each lead frame to be exposed along upper surface 36. Slots 32 also hold the lead frames 16 through 30 in position prior to being inserted into the PCB. In particular, lead frames 16, 20, 24 and 28 are associated with slots 32 in upper portion 12 and lead frames 18, 22, 26 and 30 are associated with slots 32 in lower portion 14.

Lead frames 16 through 30 traverse insert 10 from outer end 38 to inner end 40 and are substantially parallel with respect to each other. Each lead frame 16 through 30 is substantially elongated with curved or bent body portions 33, including contact portion 34, a first end portion 41 and an electrical connector pin 42 at opposing second end portion 35. Connector pins 42 extend from inner end 40 and may be mated with other components or cables. Lead frames 16 through 30 are substantially parallel and spaced in their engagement so that contact portions 34 correspond with leads in a RJ45 plug (shown in FIGS. 12 and 13). Thus, the first pair of a T568B four-paired plug would align with lead frames 22 and 24, the second pair with lead frames 16 and 18, the third pair with lead frames 20 and 26, and the fourth pair with lead frames 28 and 30.

Figure 2:
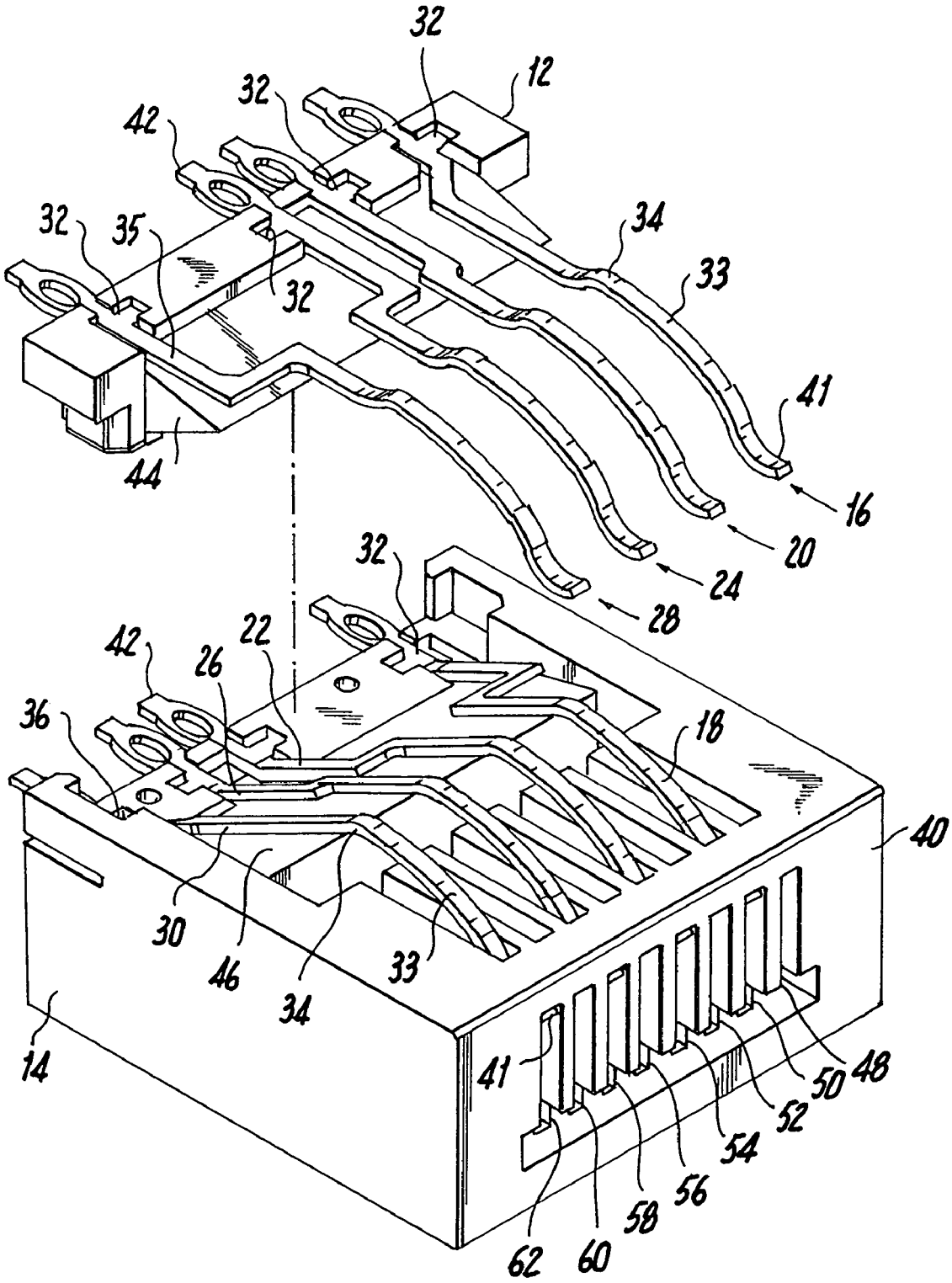
FIG. 2 is an exploded view of the exemplary insert device of the present disclosure depicted in FIG. 1.
Figure 11:
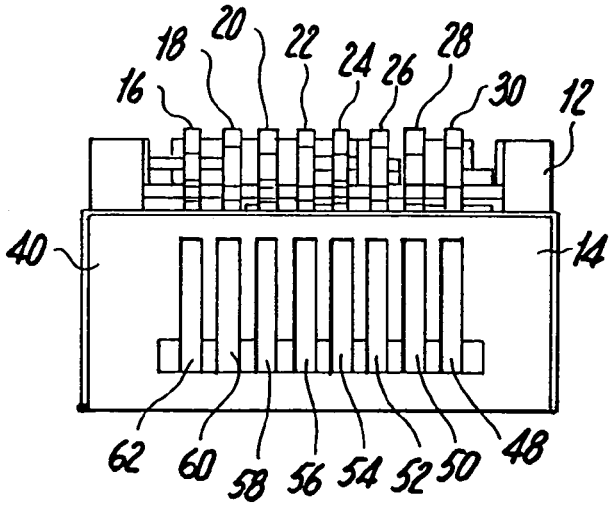
FIG. 11 is a front plan view of the embodiment of the present disclosure depicted in FIG. 1.

Referring now to FIG. 2, upper portion 12 further includes a curved support ramp 44 which extends under a portion of lead frames 16, 20, 24 and 28 for, among other things, supporting and increasing the flexibility of the lead frames. Similarly, lower portion 14 further includes a ramped support portion 46 which extends under a portion of lead frames 18, 22, 26 and 30. As also illustrated in FIG. 11, channel guilds 48, 50, 52, 54, 56, 58, 60 and 62 open along the surface of inner end 40 on lower portion 14 and engage ends 41 of lead frames 16 through 30. Channel guilds 48, 50, 52, 54, 56, 58, 60 and 62 correspond to lead frames 16, 18, 20, 22, 24, 26, 28 and 30, respectively.

Curved body portions 33 of lead frames 16 through 30 are positioned substantially parallel with respect to each other and are spaced to mate with a standard FCC RJ45 plug. At end 40 having connector pins 42, lead frames 16 through 30 are uniquely positioned relative to prior devices, due to the offset angling that advantageously reduces unwanted noises according to the present disclosure.

In preferred embodiments of the present disclosure, exemplary dimensional characteristics are as follows:

- Preferably, in the upper portion 12, the distance between lead frame 28 and 24 is about 0.190 inch, the distance between lead frame 24 and 20 ranges from about 0.050 to 0.060 inches, and the distance between lead frame 20 and 16 is about 0.1 inch.
- Preferably, in the lower portion 14, the distance between lead frame 30 to 26 is about 0.1 inch, the distance between lead frame 26 to 22 ranges from about 0.050 to 0.060 inches, and the distance between lead frame 22 to 18 is about 0.190 inch.
- Preferably, the distance between pins 42 from the lead frames in the lower portion 14 to the lead frames in the upper portion 12 is at least about 0.1 inch. This advantageous arrangement serves to reduce the pair to pair noise, which is generally introduced to the system by the TIA/EIA T568B/A plug, among other things.

Lead frames 30, 26, 22, and 18 of insert 10 are designated ring R' (i.e., negative voltage transmission) and lead frames 28, 24, 20, and 16 are designated tip T' (i.e., positive voltage transmission) polarity. For T568B category 5e and 6 frequencies, unwanted noise is induced mainly between contacts 26, 24, 22, and 20, and minor unwanted noises are introduced between contacts 18 and 20 as well as contacts 26 and 28.

Lead frames 16 through 30 are electrically short in reference to the wavelengths up to 250 MHz. According to the present disclosure, lead frames 16 through 32 optimally affect the created noise as close to the source as possible to reduce noise phase offsets and create a proper balance of the noises created by the modular plug. The offset regions are affected by the distance of compensation reactances to the original noise reactances. Thus, the further away from the source of the noise signal, the greater the offset will be. Re-balancing the original signal to remove the noise signal is best achieved by using a signal of opposite polarity than the noise signal. According to the present disclosure, an optimal point for creation of a re-balancing signal is within 0.2 inches of the noise creation region because such distance generally provides equal magnitude and phase to the original negative noise region, among other things.

Lead frames 16 through 30 are arranged in such a manner that unwanted noise via coupling in an EIA RJ45 T568B system having standard plug positions 1, 2, 3, 4, 5, 6, 7 and 8, is reduced in comparison to the standard RJ45 modular inserts. Such advantageous reduction according to the present disclosure is primarily achieved because standard RJ45 modular inserts typically have plug positions and lead frames that disadvantageously remain parallel and adjacent throughout the insert.

Figure 3:
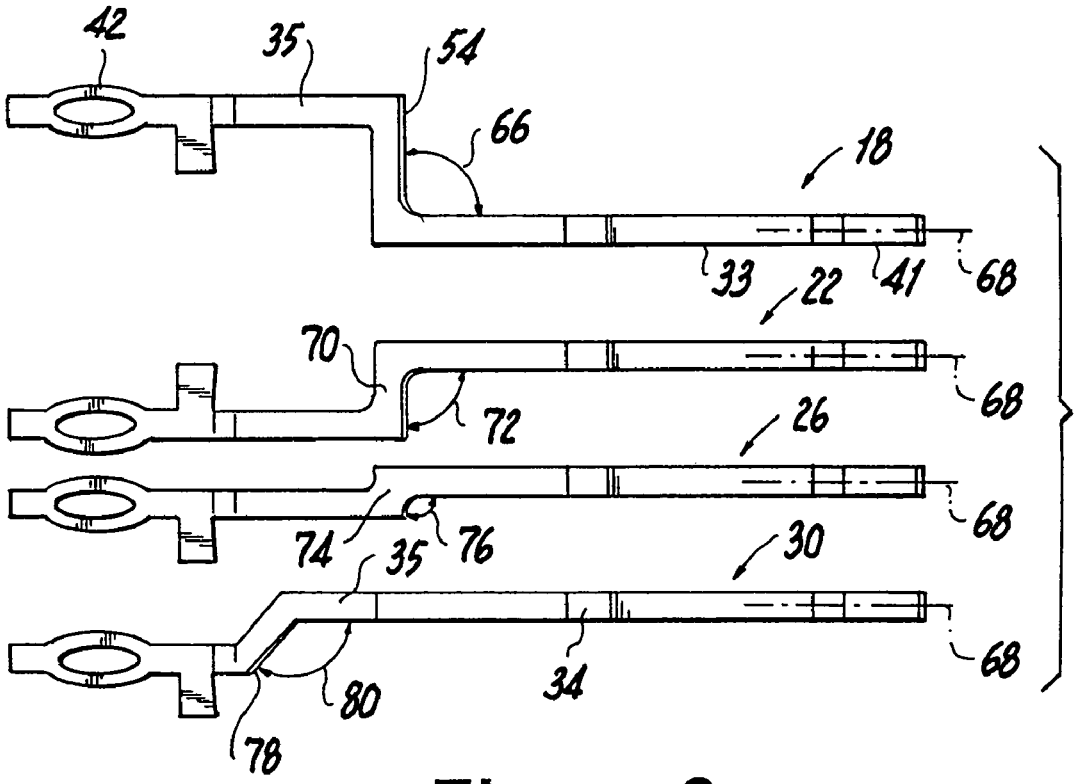
FIG. 3 is a top plan view of the lead frames associated with the upper portion of the exemplary embodiment of the present disclosure depicted in FIG. 1.

Referring to FIG. 3, lead frames 18, 22, 26 and 30 associated with lower portion 14 are shown in their respective positions outside of insert 10. Preferably, second end portion 35 of lead frame 18 is approximately twice the length of its first end portion 41, more preferably about 0.80 inches. Second end portion 35 of lead frame 18 includes a lead frame direction-altering segment 64 which extends from lead frame 18 at an angle 66 and in a direction that transverses the longitudinal axis 68 of elongated lead frame 18. Segment 64 also extends in a direction away from the position of lead frame 22 with respect to lead frame 18. Preferably, angle 66 is about 90 degrees with respect to longitudinal axis 68 of lead frame 18. Second end portion 35 of lead frame 22 includes segment 70 which extends from lead frame 22 at an angle 72 and in a direction that transverses longitudinal axis 68 of lead frame 22.

Segment 70 is directed away from the position of lead frame 18 with respect to lead frame 22. Second end portion 35 of lead frame 26 includes segment 74 which extends from lead frame 26 at an angle 76 and in a direction that transverses longitudinal axis 68 of lead frame 26. Segment 74 is directed away from the position of lead frame 22 with respect to lead frame 26. Second end portion 35 of lead frame 30 includes segment 78 which extends from lead frame 30 at an angle 80 and in a direction that transverses longitudinal axis 68 of lead frame 30. Preferably, angle 80, is greater than 90 degrees. Segment 78 is directed away from the position of lead frame 26 with respect to lead frame 30.

Figure 4:
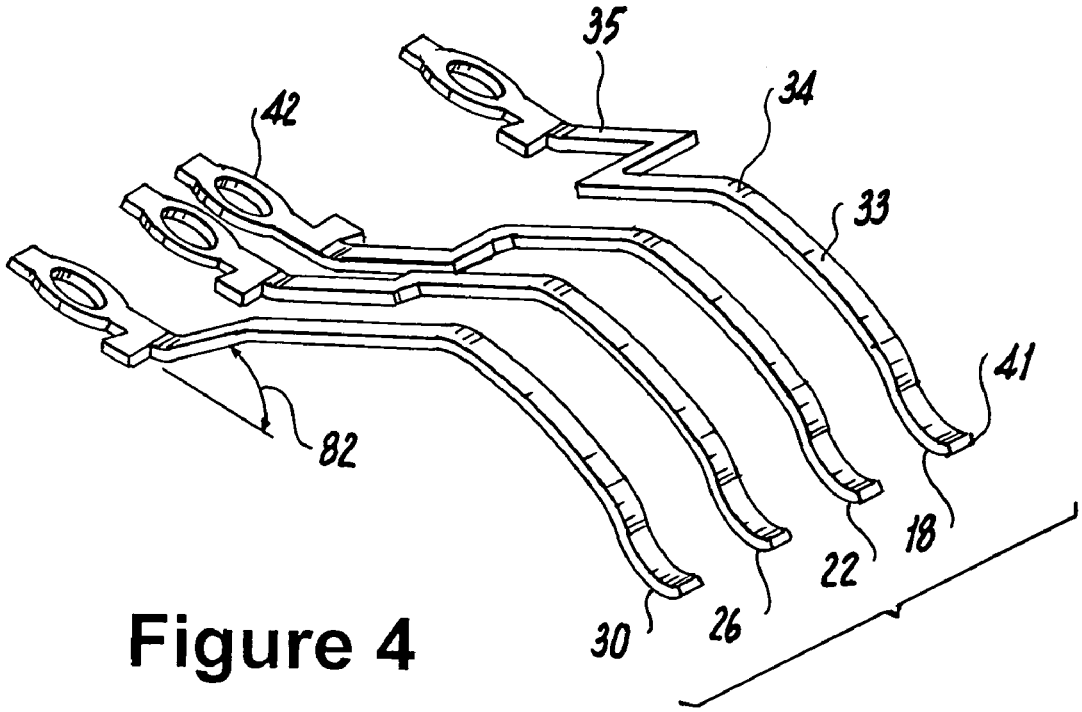
FIG. 4 is a perspective view of the lead frames associated with the upper portion of the embodiment of the present disclosure depicted in FIG. 1.

FIG. 4 illustrates the curvature of body portion 33 in lead frames 18, 22, 26 and 30. Lead frames 18, 22, 26 and 30 are parallel along longitudinal axis 68 and are curved upward with respect to insert 10 at an angle 82. Preferably, angle 82 is about 30 degrees. According to the present disclosure, angle 82 advantageously provides for the pre-load stress of mating with a plug and increases the lead frame contact force to an estimated 100 grams or more, among other things.

Figure 5:
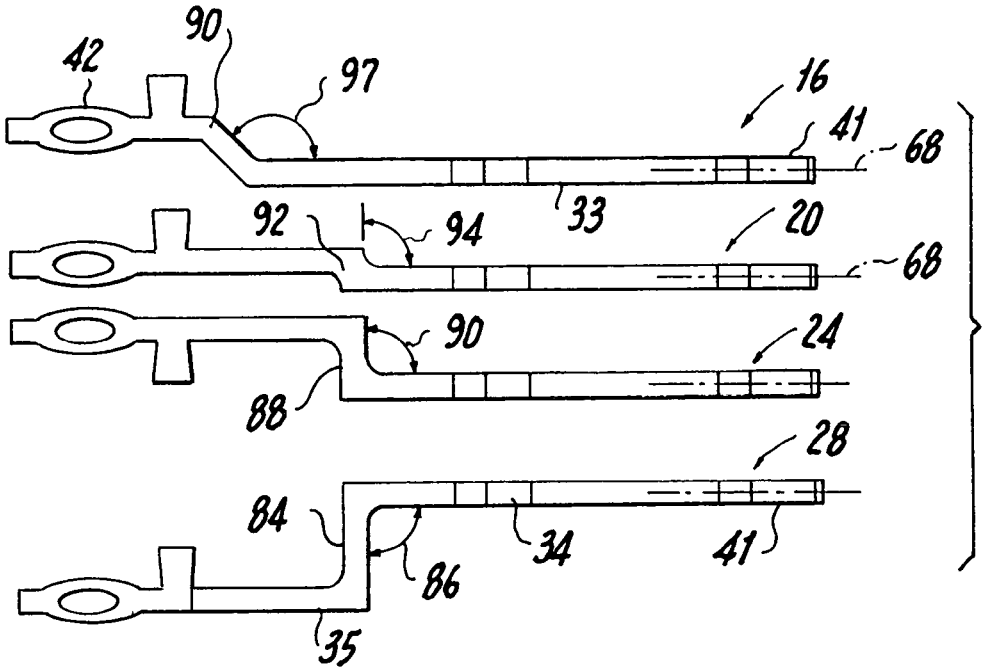
FIG. 5 is a further top plan view of the lead frames associated with the lower portion of the embodiment of the present disclosure depicted in FIG. 1.

Referring to FIG. 5, lead frames 16, 20, 24 and 28 associated with upper portion 12 are shown in their respective positions outside of insert 10. Preferably, second end portion 35 of lead frame 28 is approximately twice the length of its first end portion 41, more preferably about 0.80 inches. Second end portion 35 of lead frame 28 includes a direction-altering segment 84 which extends from lead frame 28 at an angle 86 and in a direction that transverses the longitudinal axis 68 of elongated lead frame 28. Segment 84 also extends in a direction away from the position of lead frame 24 with respect to lead frame 28. Preferably, angle 86 is about 90 degrees with respect to longitudinal axis 68 of lead frame 30. Second end portion 35 of lead frame 24 includes segment 88 which extends from lead frame 24 at an angle 90 and in a direction that transverses longitudinal axis 68 of lead frame 26.

Segment 88 is directed away from the position of lead frame 24 with respect to lead frame 28. Second end portion 35 of lead frame 20 includes segment 92 which extends from lead frame 26 at an angle 94 and in a direction that transverses longitudinal axis 68 of lead frame 20. Preferably, angle 94 is about 90 degrees. Segment 94 is directed away from the position of lead frame 24 with respect to lead frame 20. Second end portion 35 of lead frame 16 includes segment 96 which extends from lead frame 16 at an angle 98 and in a direction that transverses longitudinal axis 68 of lead frame 16. Preferably, angle 98 is greater than 90 degrees. Segment 96 is directed away from the position of lead frame 20 with respect to lead frame 16.

Figure 6:
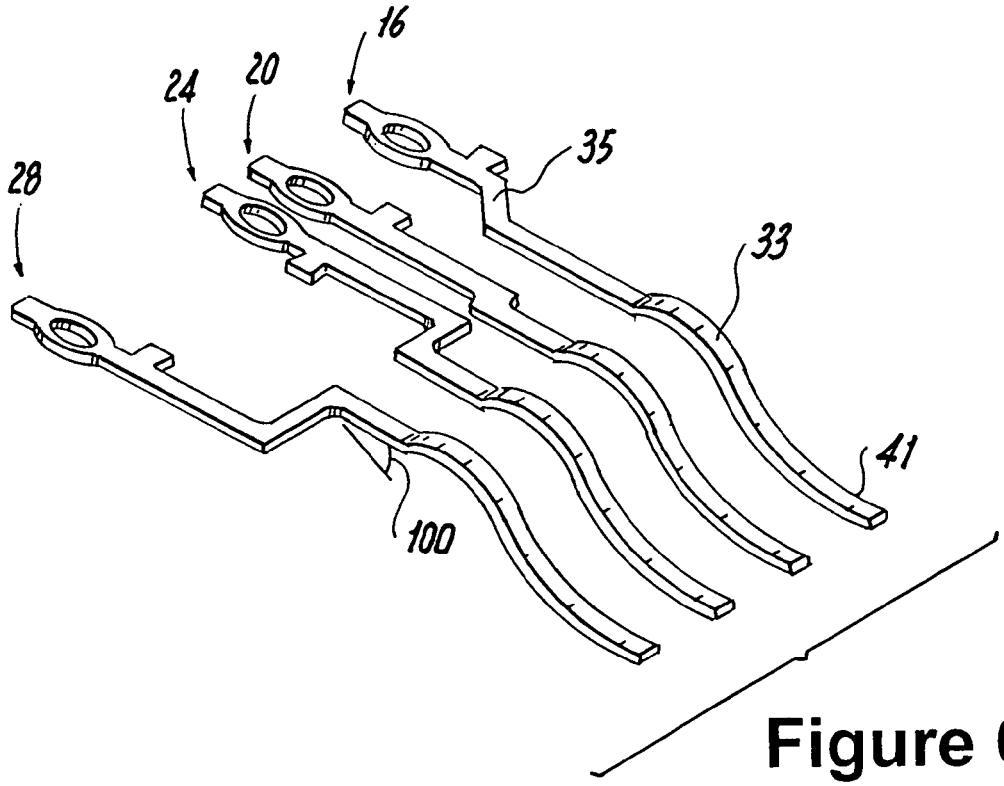
FIG. 6 is a perspective view of the lead frames associated with the upper portion of the embodiment of the present disclosure depicted in FIG. 1.

FIG. 6 illustrates the curvature of body portion 33 in lead frames 16, 20, 24 and 28. Lead frames 16, 20, 24 and 28 are parallel along longitudinal axis 68 and are curved upward with respect to insert 10 at an angle 100. Preferably, angle 100 is about 10 degrees. According to the present disclosure, angle 100 provides for the pre-load stress of mating with a plug and increases the lead frame contact force to an estimated 100 grams or more, among other things.

Figure 7:
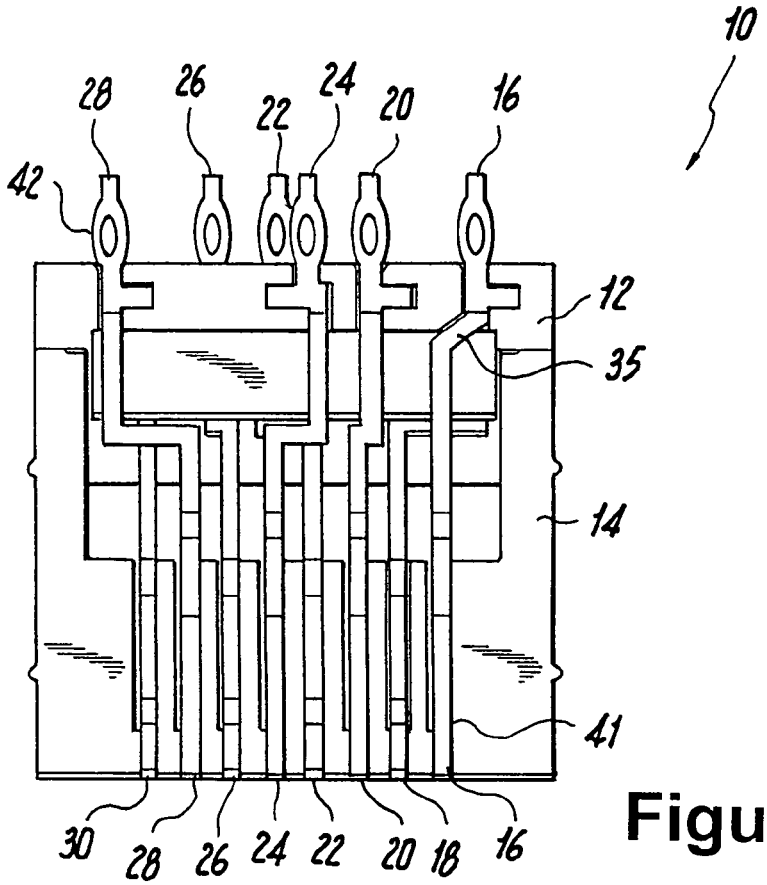
FIG. 7 is a top plan view of the embodiment of the present disclosure depicted in FIG. 1.
Figure 8:
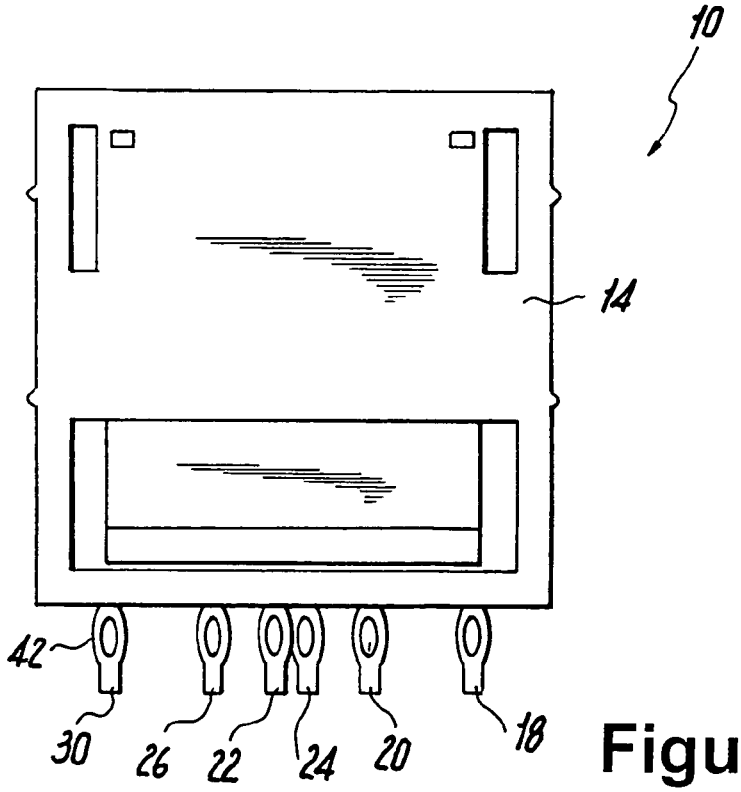
FIG. 8 is a bottom plan view of the embodiment of the present disclosure depicted in FIG. 1.
Figure 10:
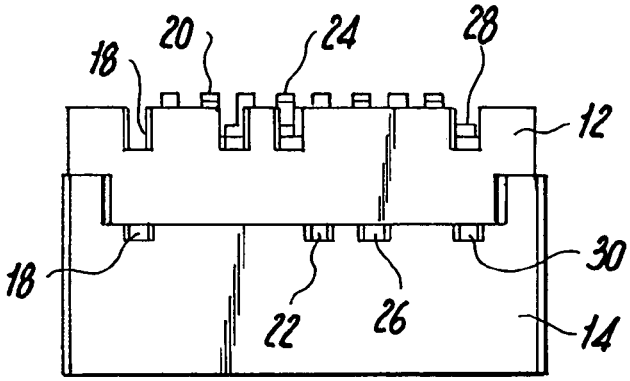
FIG. 10 is a rear plan view of the embodiment of the present disclosure depicted in FIG. 1.

As illustrated in FIGS. 7, 8 and 10, inclusion of the various direction-altering segments in lead frames 16 through 30 results in placement of pins 42 at end 35. Such placement does not necessarily reflect the relative order of lead frames 16 through 30 at end 41.

Figure 9:
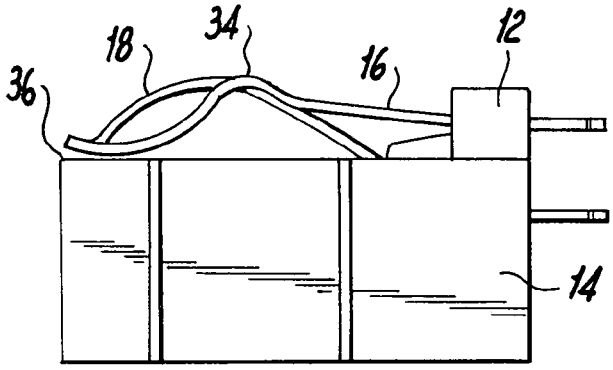
FIG. 9 is a side plan view of the embodiment of the present disclosure depicted in FIG. 1.

FIG. 9 illustrates the difference in angles 82 and 100 between lead frames 18, 22, 26 and 30 associated with lower portion 14 and lead frames 16, 20, 24 and 28 associated with upper portion 12, respectively. The RJ45 plug electrical contacts meet with contact portions 34. Contact portions 34 are at substantially the same distance away from surface 36 and at the same location near the midpoint of insert 10 for all lead frames 16 through 30. These factors aid in reducing unwanted noise reactances, among other things.

Figure 12:
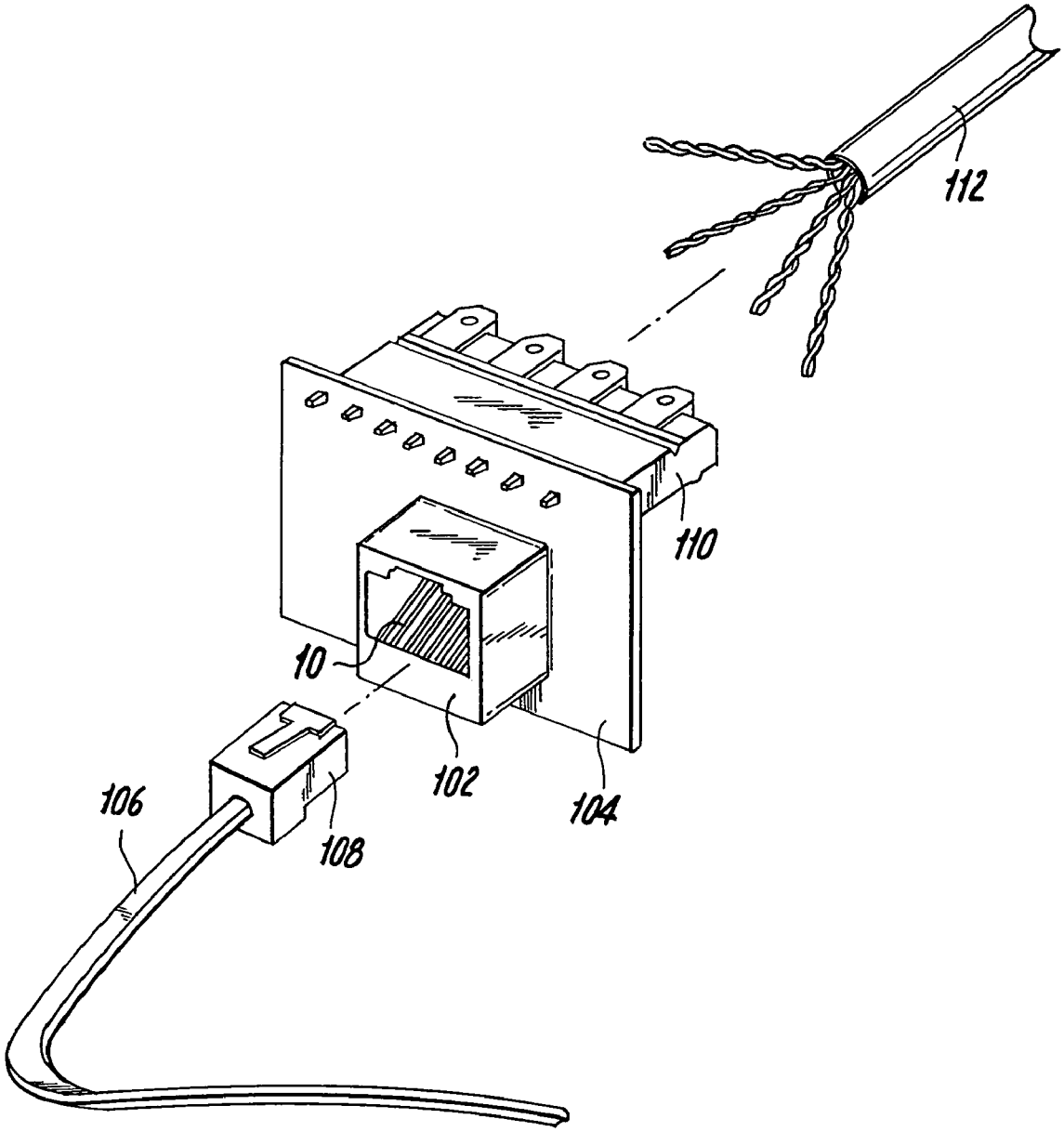
FIG. 12 is a perspective view of an exemplary arrangement of components used with the inserts fabricated in accordance of the present disclosure.
Figure 13:
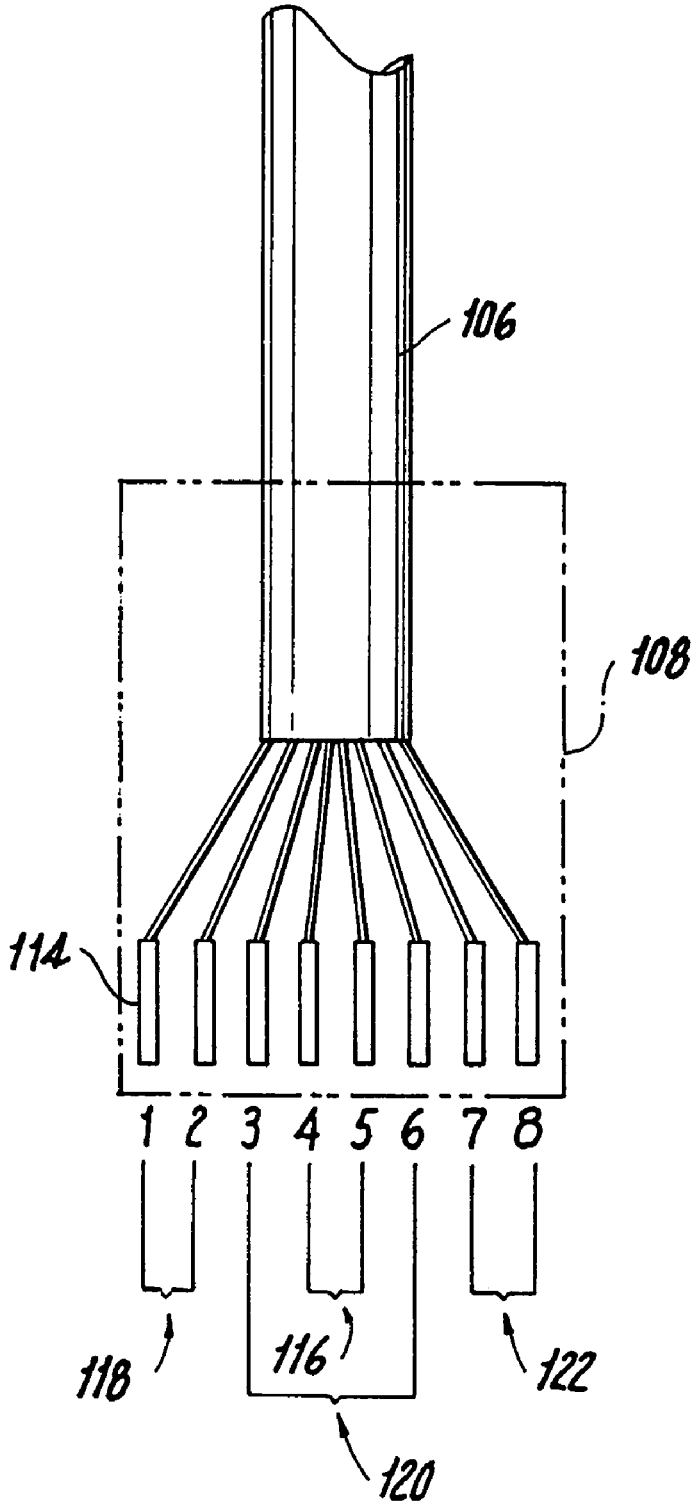
FIG. 13 is a view of a RJ45 plug illustrating the standard arrangement of the RJ45 plug contacts.

FIG. 12 illustrates an example of insert 10 in use. Insert 10 is secured in modular housing 102 of a standard type used in a multitude of conventional electronic applications, such as for connecting to a network wall outlet, computer, or other data transfer device. Modular housing 102 with insert 10 is electrically connected to a printed circuit board ("PCB") 104 which may also contain signal transmission traces and/or extra coupling circuitry for re-balancing signals. Signals transfer from UTP cable 106 and into insert 10 through RJ45 type plug 108. As illustrated in FIG. 13, the signal from cable 106 is transmitted via plug contacts 114 in plug 108, which make electrical contact substantially at contact portions 34 on lead frames 16 through 30. Each pair of plug contacts 114 mates with a lead frame associated with upper portion 12 and a lead frame associated with lower portion 14 of insert 10. The signal transfers from insert 10 via pins 42 into PCB 104. The signal is transferred from PCB 104 to insulation displacement contacts ("IDC") 110 which is connected to a second UTP cable 112, thus completing the data interface and transfer through insert 10.

In the 4 pair connecting hardware system, multiple pairs of plug contacts 114 for data signal transmission are provided. These contact positions generally correspond to lead frames. The first pair 116 of plug contacts 114 mates with lead frames 22 and 24, the second pair 118 with lead frames 16 and 18, the third pair 120 with lead frames 20 and 26, and the fourth pair 122 with lead frames 28 and 30.

A significant portion and, in many instances, a majority of the coupled noise associated with the RJ45 plug arises from the adjacency of the paired arrangements. On a relative basis, the worst case NEXT noise in a RJ45 plug is a balance coupled negative noise, meaning the noise is coupled equally upon the adjacent pairs. Thus, with reference to FIG. 13, the worst effect in a 4 pair RJ45 plug module is typically exhibited in plug contacts numbered as 3, 4, 5 and 6, corresponding to pairs 116 and 120 and lead frames 20 through 26, because both sides of the transmitting and receiving signal are adjacent to each other. The other pairs of a RJ45 plug also create noise problems, but such problems are of significantly lesser magnitude because only one wire of the pair is the noise source.

With further reference to the Figures, the input signal from plug 108 is split into two separate reactances at contact portion 34. One portion of the signal is directed towards end portion 35 of the lead frames and the other towards end portion 41 of the lead frames. The signal portion directed towards end 35 of the lead frames flows into PCB 104 for energy transmission to the output UTP cable 112 connected with IDC 110. Signals in lead frames 22 and 24 of pair 1 are capacitively and inductively coupled upon pair 3 connected lead frames 20 and 26, e.g., by approximately 0.18 pF, which increases the positive signal inductance coupling by approximately 3.6 nH. Lead frame 20 from pair 3 is capacitively and inductively coupled upon the lead frame 18 from pair 2, e.g., by approximately 0.11 pF, which increases the positive signal inductance coupling by approximately 3.1 nH. The lead frame 24 from pair 1 is also designed to reduce its coupling effect upon-the lead frame 30 from pair 2 reducing its parallelism via direction-altering segments in the lead frames.

The signal portion directed away from PCB 104 toward end portions 41 of the lead frames results in static energy coupling from the input signals. Lead frames 22 or 24 of pair 1 are capacitively coupled upon lead frames 20 or 26 of pair 3. Also, lead frames 20 or 26 from pair 3 is capacitively coupled upon lead frames 18 or 16 from pair 2 and lead frames 28 and 30 from pair 4. A portion of lead frame 22 or 24 of pair 1 capacitively coupled upon one lead frame 28 or 30 of pair 4 and lead frame 16 or 18 of pair 2.

The formation of lead frames 16 through 30 results in splitting the signal and reducing crosstalk noises by, among other things, causing separate and dual reactances, that is, one being the inductive/capacitive reactances combination and the other being the static mode capacitive reactance. The lead frames may be arranged and/or bent in different formats. One format aligns all contacts in order, which increases the parallelism of the wire pairs. The other format, in accordance with the present disclosure, aligns all contacts in two distinct bends, with the lead frames associated with upper portion 12 in parallel to each other, and the lead frames associated with the lower portion 14 in parallel to each other, but not parallel with regard to lead frames of differing associations, which reduces NEXT more effectively.

By enhancing and reducing the parallelism of the lead frames at opposing end portions in accordance with the known coupling problems inherent in the RJ45 plug system, lower capacitive and inductive coupling will occur as the frequency increases up to 250 MHz. The advantageous end result is an insert device that has lower NEXT, FEXT and impedance in certain wire pairs. The reduction of a majority of crosstalk noise occurs by combining indirect and direct signal coupling in the lead frames associated with central pairs 1 and 3, as well as the other pairs 2 and 4 in the RJ45 plug.

Negative noise that was introduced is counter coupled with positive noise, thereby reducing the total noise effects and re-balancing the wire pairs output. The lead frames are electrically short, e.g., approximately less than 0.27 inches, which reduces the negative noise coupling by reducing the parallelism of the adjacent victim wire and reducing the signal delay to a PCB that could contain further coupling circuitry. The additive positive noise and reduction of the unwanted negative noise coupling of the lead frame wires work at precisely the same moment in time, which allows optimal reduction for lower capacitive and inductive coupling. The combination of the split signals provides an enhanced low noise dielectric modular housing for high speed telecommunication connecting hardware systems, among other things. The advantageous end result is a modular insert device that has lower NEXT, FEXT and impedance within its wire pairs.

Thus, the present disclosure provides a system, device and method for reducing crosstalk noise without requiring new equipment or expensive re-wiring. The victim crosstalk noise is eliminated by a combination of the appropriately placed positive feedback signal reactance circuitry and by utilizing a noise balancing dual reactance dielectric insert. This operation is accomplished by forming the appropriate contacts within the dual reactance dielectric insert for noise reduction. By using the dual reactance dielectric insert, the amount of unwanted signals can be induced to cancel that which was injected by the plug input, thus increasing the system's signal to noise ratio and network's bit error rate.

This method and system approach provides a more laboratory controlled product than other crosstalk reduction designs, which greatly improves design time, efficiency and cost. This method and system approach also provides a way to effectively remove crosstalk in a very small amount of printed circuit board space as compared to conventional crosstalk reduction designs.

Signal noise is re-balanced by the offsetting change in lead frame design, i.e., from a parallel to asymmetrical or almost perpendicular relationship between respective lead frames in the dielectric insert before the signal enters into the PCB. Exemplary devices in accordance with the present disclosure have a typical NEXT value of no greater than −46 dB and a FEXT value that is typically no greater than −50 dB. A standard modular insert typically exhibits a NEXT value of −37 dB and the FEXT is typically −40 dB. An insert device according to the present disclosure thus reduces the differential noise input voltage ratio signal by greater than fifty percent.

Although the disclosed method has been described with respect to preferred embodiments, it is apparent that modifications and changes can be made thereto without departing from the spirit and scope of the invention as defined by the appended claims.

The invention claimed is:

1. An arrangement for compensating cross-talk noise in an electrical signal, comprising:

a printed circuit board that is adapted to be mounted with respect to a dielectric modular jack and a plurality of insulation displacement connectors; and a dielectric modular jack mounted with respect to the printed circuit board, the dielectric modular jack including:

(i) a dielectric modular jack housing defining a signal transmission media receiving space;

(ii) an insert positioned within the dielectric modular jack housing, the insert including an upper portion defining a first set of slots and a lower portion defining a second set of slots, (iii) a plurality of pairs of elongated conductors disposed in the dielectric modular jack housing and disposed relative to the signal transmission media receiving space, each elongated conductor of the plurality of elongated conductors having a front end portion and a back end portion, the back end portion including a connecting device for connecting with the printed circuit board and the front end portion being received in one of the first or second slots and including a contact portion for engaging one of a plurality of conductive leads, wherein each of the pairs of elongated conductors included an angled portion that extends within the signal transmission receiving space above the upper portion and the lower portion of the insert; and wherein the plurality of pairs of elongated conductors are in a positional relationship with respect to each other to form a capacitance for compensating electrical noise in a signal transmission.

2. An arrangement as in claim 1, wherein there are four pairs of elongated conductors.

3. An arrangement as in claim 1, wherein front end portions are substantially arcuate.

4. An arrangement as in claim 1, wherein the electrically conductive media comprises an untwisted pair cable.

5. An arrangement as in claim 1, wherein the upper portion and the lower portion of the insert are fabricated from a low dielectric material.

6. An arrangement as in claim 1, wherein the upper portion is seated on the lower portion of the insert.

7. An arrangement as in claim 1, wherein four elongated conductors are associated with the first set of slots and four elongated conductors are associated with the second set of slots.

8. An arrangement as in claim 1, wherein a first conductor from each pair of elongated conductors is associated with the first set of slots and a second conductor from each pair of elongated conductors is associated with the second set of slots.

9. An arrangement as in claim 1, wherein the upper portion of the insert includes a first ramped support portion.

10. An arrangement as in claim 1, wherein the lower portion of the insert includes a second ramped support portion.

11. An arrangement as recited in claim 1, wherein the front end portions are substantially parallel with respect to each other along a longitudinal axis.

12. An arrangement as in claim 11, wherein the rear end portions are partially parallel and partially transverse with respect to the axis.

13. An arrangement as in claim 1, wherein each of the plurality of pairs of elongated conductors includes a first elongated conductor and a second elongated conductor, and wherein the first elongated conductor is angled relative to the insert at a first angle and the second elongated conductor is angled relative to the insert at a second angle, and wherein the first angle is different from the second angle.

14. An arrangement as in claim 13, wherein the first angle is about 30 degrees and the second angle is about 10 degrees.

15. An arrangement as in claim 13, wherein the angling of the first elongated conductor and the second elongated conductor provides a pre-load stress for mating with a plug.

* * * * *